United States Patent [19]

Hodson

[11] Patent Number: 4,462,595

[45] Date of Patent: Jul. 31, 1984

[54] ADJUSTABLY ALIGNABLE GOLF CLUB

[76] Inventor: Layne O. Hodson, 2744 E. Kayscreek Dr., Layton, Utah 84041

[21] Appl. No.: 477,170

[22] Filed: Mar. 21, 1983

[51] Int. Cl.[3] ..... A63B 69/36

[52] U.S. Cl. ..... 273/164; 273/81 B; 273/77 R; 273/162 F

[58] Field of Search ..... 273/162 R, 163 R, 163 A, 273/164, 77 R, 193 B, 194, 162 F, 81 B

[56] References Cited

U.S. PATENT DOCUMENTS 1,331,499 2/1920 Hartford ..... 273/163 R

*Primary Examiner*—George J. Marlo

*Attorney, Agent, or Firm*—A. Ray Osburn

[57] ABSTRACT

A golf putter or driver of improved accuracy, having a retractable spike member adapted to be inserted into the sod of the green or fairway to hold the club temporarily unattended in upright position next to the ball to be struck. The golfer may then visually check the club alignment from a vantage point and correct it by rotating the club. The spike is then manually withdrawn from the sod without moving the club and the putt or drive then made. The spike is housed within the hollow shaft of the club and passes through an aligned bore provided through the club head. At the upper end of the elongate spike, a knob or the like is provided for extending and retracting the spike. According to one aspect of the invention, a spring may be incorporated inside the stem to aid in withdrawing the spike from the sod.

10 Claims, 8 Drawing Figures

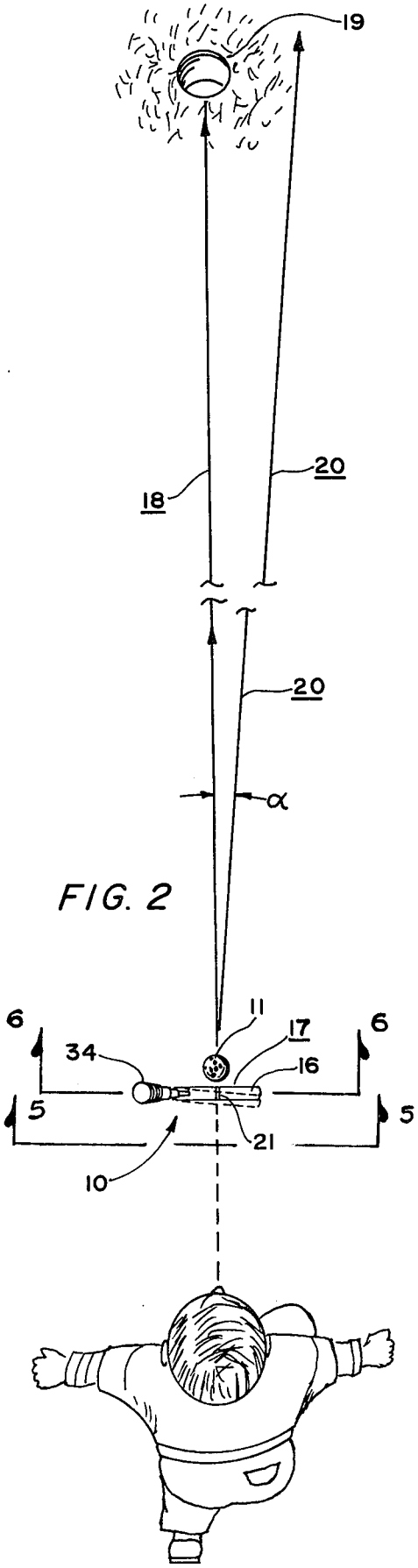
FIG. 2
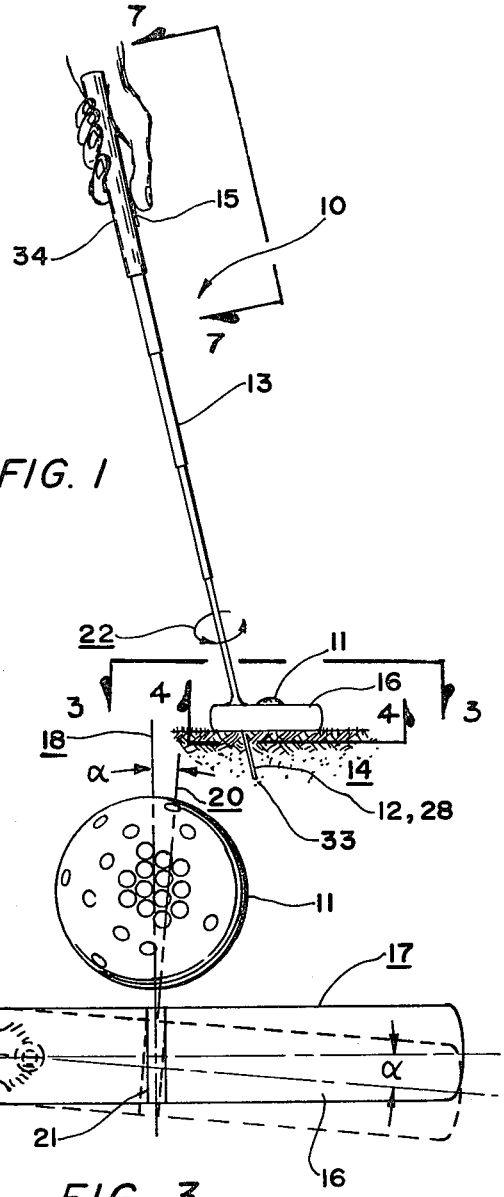
FIG. 1
FIG. 3
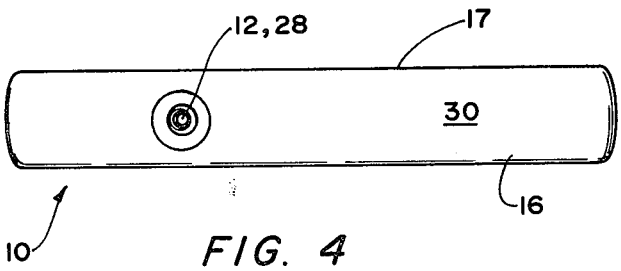
FIG. 4

ADJUSTABLY ALIGNABLE GOLF CLUB

BACKGROUND OF THE INVENTION

1. Field

The field of the invention includes devices for improving the accuracy of putts and drives in the game of golf, particularly devices to provide accurate initial alignment of the club head with the ball before the driving or putting swing.

2. State of the Art

Consistently accurate putting and driving generally require that the club head strike the ball while moving in a line desired by the golfer, generally selected to pass through the ball and the cup. Further, the striking face of the club head must be positioned accurately perpendicular to the direction of the club motion, to avoid slicing, hooking and undesired spin of the ball. The club head is initially positioned visually to be as perpendicular as possible to the intended line of travel of the ball, and the golfer then selects his stance to swing the head of the club through the same position and along the intended line of travel of the ball at the point of impact. However, the golfer's eyes are initially positioned generally vertically above the ball and the club head, and the cup and the ball are not simultaneously within his field of view. The club head alignment and the golfer's stance tend to be inaccurately selected, although the top of the club head generally includes an alignment mark perpendicular to its striking surface. Reportedly, other clubs have included mirrors or prisms attached to the club head. Hopefully these would enable the golfer to view both the ball and the cup simultaneously. Any irregularities in the green or fairway would make such devices inoperable by obstructing the view. And, if such actually exist, they undoubtedly disturb the balance of the club so that an accurate swing is very difficult to achieve.

BRIEF SUMMARY OF THE INVENTION

With the foregoing in mind, the present invention eliminates or substantially alleviates the disadvantages in prior art golf clubs, by providing means for holding the club temporarily in adjustable, upright ball striking position. The golfer then moves away from the club to a vantage point to visually observe the alignment and perpendicularity of the club head with the intended line of travel of the ball. The club is then adjusted to correct any discrepancy in its alignment, and its new position visually rechecked from the vantage point before the putt or drive. The club is held in upstanding position by a retractable spike preferably housed axially in the tubular handle stem commonly utilized. When extended, the spike protrudes through a bore in the head of the club into the turf or the green or fairway to support the club unaided. To adjust the club head position, the club, including the spike, is rotated as necessary about the longitudinal axis of the handle. When the position is finally adjusted, the spike is withdrawn manually preparatory to the subsequent swing, without disturbing the position of the club. Advantageously, the spike member is adapted to be both inserted and withdrawn at the gripping portion of the handle. Spring assist means may be provided for withdrawing the spike, and for positively maintaining the spike in withdrawn position during the swing.

BRIEF DESCRIPTION OF THE DRAWINGS

In the drawings, which represent the best mode presently contemplated for carrying out the invention:

FIG. 1 is a reduced scale elevation view of a golf club placed in preliminary position next to a golf ball preparatory to a putt, FIG. 2 a plan view of the club of FIG. 1 shown temporarily supported in upright position upon the turf of a golf course, a golfer being indicated in position to check the alignment of the head of the club, drawn to the same scale as FIG. 1, FIG. 3 a substantially full scale plan view of a lowermost fragment of the club of FIG. 1, taken along line 3—3 thereof, showing the club head in dashed lines improperly aligned with the ball, FIG. 4 a bottom view of the club of FIG. 1, taken along line 4—4 thereof, the support spike however being indicated as withdrawn into the club, drawn to the scale of FIG. 3, FIG. 5 a side elevation view of the club of FIG. 2, taken along line 5—5 thereof, cut away to show the bore through the head and the support spike, drawn to the scale of FIG. 3, FIG. 6 a vertical sectional view of the uppermost fragment of the club of FIG. 2, taken along line 6—6 thereof, drawn to the scale of FIG. 3.

DETAILED DESCRIPTION OF ILLUSTRATED EMBODIMENTS

Figure 8:
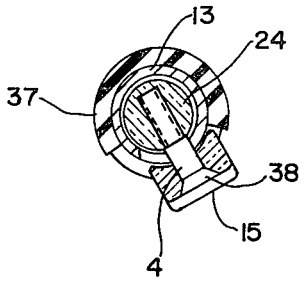
FIG. 8 is a cross sectional view of the club of FIG. 7, taken along line 8—8 thereof, drawn to the same scale.

The adjustably alignable club 10 is now described with reference to the drawings, in which a putter is utilized for illustrative purposes. Club 10 may be similarly embodied in fairway clubs to be utilized in the same manner.

In FIG. 1, club 10 is illustrated in initial putting position relative to a golf ball 11. An elongate club support spike 12 is housed generally within tubular club stem 13, and is shown being inserted into the turf 14 by the thumb of the golfer acting upon a spike actuating knob 15.

FIG. 2 illustrates the importance of the initial orientation of club head 16. The golfer generally endeavors to swing club 10 so that club head 16 comes back to a preselected position when it hits the ball. In most putting (or driving) situations, driving face 17 of club head 16 must for accuracy be closely perpendicular to the line 18 through ball 11 and cup 19. Small angular deviations, ($\alpha$), from the perpendicular causes the ball not to follow path 18 to the cup 19, but to follow path 20 missing cup 19. FIG. 3, drawn to larger scale, illustrates more clearly the problem of alignment of club head 16 with ball and cup. FIG. 4 shows the bottom of club 10 with spike 12 in withdrawn position.

From the putting stance, the golfer cannot easily view the cup, ball and club head simultaneously. The club head position, and the golfer's corresponding stance, must therefore be selected essentially from memory. However, the golfer may leave club 10 in initial free standing position at the ball to assume a vantage position to view club head 16, ball 11, cup 19 and desired path 18 all at once in line with his eye. (FIG. 2) Alignment errors $\alpha$ are much more easily detected by the golfer in such a position. Aiming mark 21, carried by most clubs is of considerable aid.

After perceiving the misaligned position of the club, the golfer returns to the club to rotate head 16, along with spike 12 as indicated in FIG. 1 (arrow 22), until it is more nearly in the desired position. Club head 16 tends to move slightly downward towards the turf. This is not troublesome since the amount of adjustment is normally only a few degrees. The golfer may confirm the corrected position from the viewing position of FIG. 1, before finally assuming his putting stance and withdrawing spike 12, by upward pulling upon knob 15, without disturbing the club position. As later described, a spring assist may be provided for withdrawal of spike 12. After the golfer has repeatedly used this method, he becomes more proficient in accurately placing the club head initially, and he becomes less dependent upon using spike 12.

Figure 5:
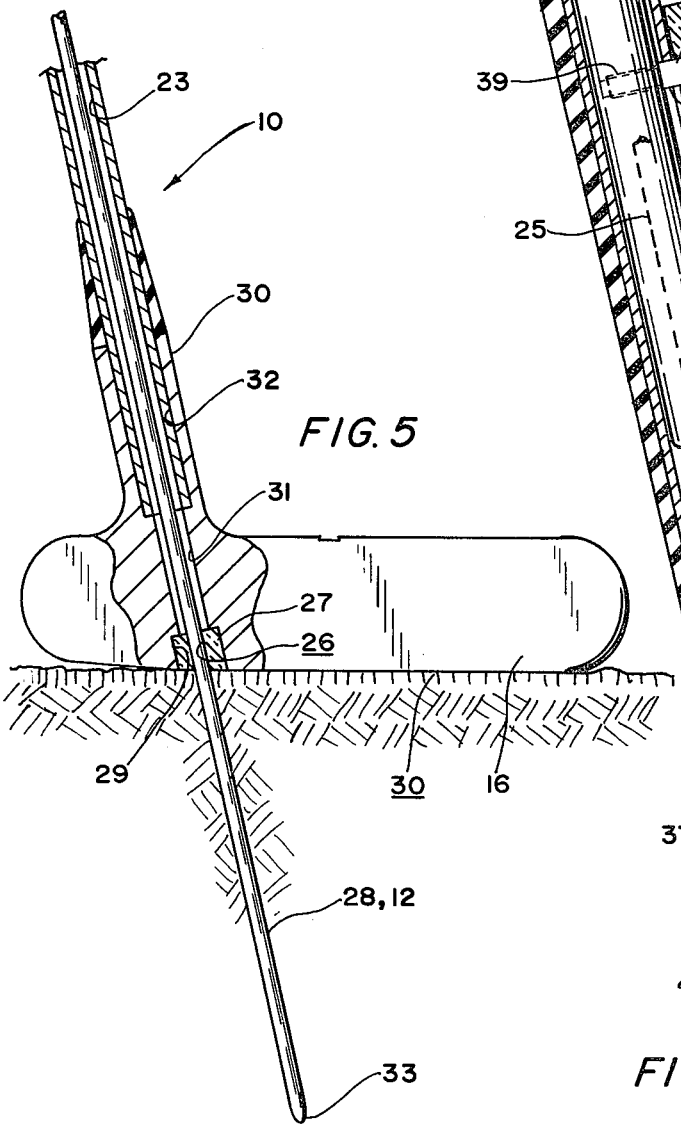
Figure 6:
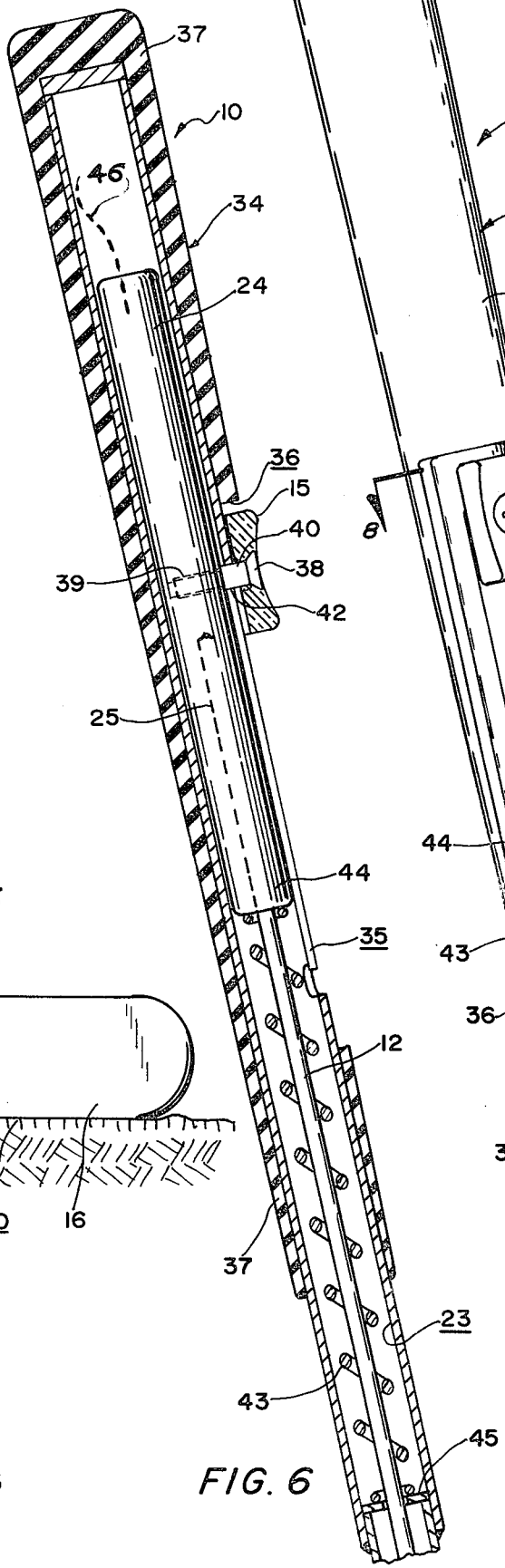
Figure 7:
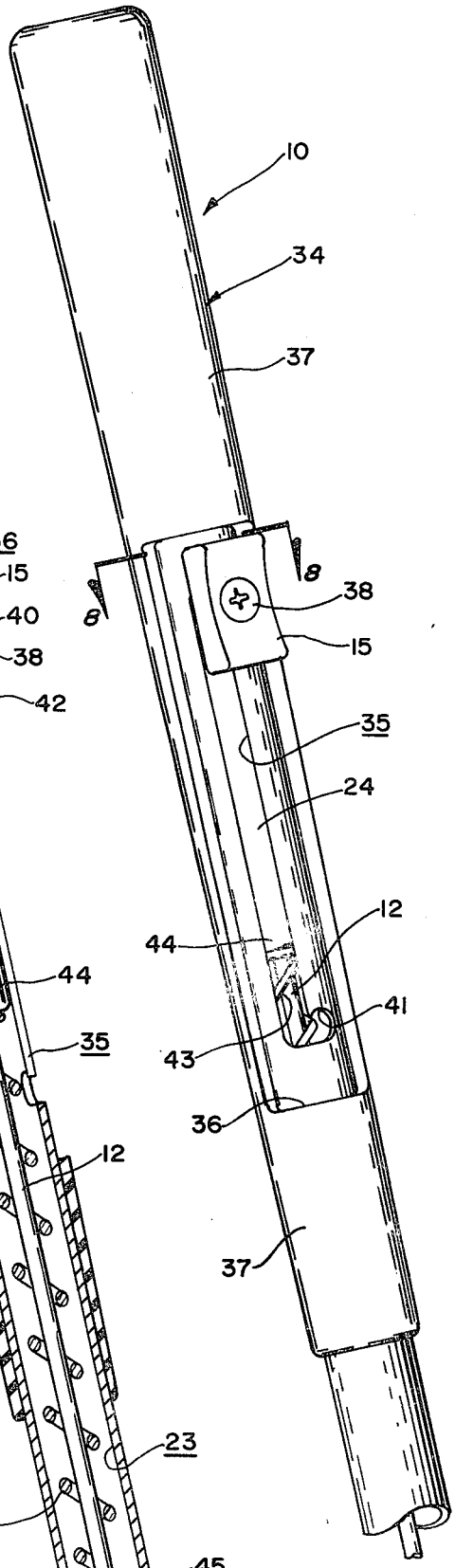
FIG. 7 is a side elevation view of the uppermost fragment of the club of FIG. 1, taken along line 7—7 thereof, drawn to the scale of FIG. 3.

The detailed construction of adjustably alignable club 10 is now described. (FIGS. 5–8) Club support spike 12 is installed in bore 23 of club stem 13. A guiding plug 24 secures the upper end of spike 12 press fitted within a blind bore 25. A bore 26 in a plastic wiper insert 27 guides the bottom portion 28 of spike 12. Insert 27 is secured within a larger bore 29 extending upwardly from the bottom surface 30 of club head 16. An intermediately sized bore 31 provides clearance for spike 12 and connects with a still larger bore 32 in the shank 30 of club 10, in which the lower portion of tubular stem 13 is retained. Advantageously, the upper end of bore 26 is funnelled outwardly to facilitate the assembly of club 10 by guiding the pointed end 33 of spike 12.

The upper (gripping) section 34 of club stem 13 has a longitudinal slot 35 the length of a recess 36 provided in gripping material 37. The actuation knob 15 is secured to guide plug 24 by a screw 38 engaging a threaded bore 39 in guide plug 24. A shoulder 40 of screw 38 extends into slot 35 to guide knob 15. It is advantageous to provide also notches 41 and 42 into which shoulder 40 may be rotated to retain spike 12 in extended or withdrawn position respectively.

An elongate spring may be provided to aid in spike withdrawal from the turf, as hereinbefore indicated, such as a compression spring 43. Compression spring 43 may be installed about spike 12 between the lower end 44 of guide plug 24 and a spring retaining washer 45, which may be conveniently seated against the end of the next lower section of club stem 13. (Most club stems are made up of several tubular sections of decreasing diameter from the top to the bottom.) Spring 43 is best selected to be highly compressible to about one fourth of its extended length to provide the necessary travel required of spike 12 as it is inserted into the sod of the golf fairway or green through bore 26. Other spring arrangements could of course be employed without departing from the essential spirit of the invention. These include tension springs, and the leaf spring 46 shown in dashed lines in FIG. 6. The latter does not aid in spike withdrawal, but serves to provide friction to retain spike 12 in withdrawn position during carrying and during the swing, for embodiments not having spike withdrawal springs.

Another embodiment of the club (not illustrated) could, for example, utilize a spike 12 lengthened to extend through the top of the gripping portion 34, equipped with a knob 15 at that location, without departing from the spirit of the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A golf club having a head portion adapted to strike a golf ball, and a stem portion extending upwardly from the head portion and having a portion adapted to be gripped by the golfer, wherein:

the stem portion is tubular and continuously hollow from the head portion to and into the gripping portion of the club;

the head portion has an open ended bore therethrough axially aligned with the tubular stem portion; and said golf club further comprises an elongate spike installed within the stem portion and the bore through the head portion, and the club further comprises handle means connected to the spike for inserting the lower end of the spike into the turf of the golf course and withdrawing it therefrom without moving the club.

2. The golf club of claim 1, wherein:

the tubular stem has an elongate slot through its wall parallel to its axis; and the handle means comprises knob means secured to the spike through the slot.

3. The golf club of claim 2, further comprising:

spring means within the stem to aid in withdrawal of the spike from the turf.

4. The golf club of claim 3, further comprising:

guide plug means within the tubular stem, to which the upper portion of the spike is secured.

5. The golf club of claim 2, further comprising:

guide plug means within the tubular stem, to which the upper portion of the spike is secured; and leaf spring means secured to the guide plug and bearing frictionally against the inside of the wall of the tubular stem.

6. The golf club of claim 1, further comprising:

spring means within the stem to aid in withdrawal of the spike from the turf.

7. The golf club of claim 6, further comprising:

guide plug means within the tubular stem, to which the upper portion of the spike is secured.

8. The golf club of claim 1, wherein:

the club head has a spike wiper insert having the lowermost portion of the head bore therethrough.

9. The golf club of claim 1, further comprising:

leaf spring means attached to the spike and bearing frictionally against the inside of the wall of the tubular stem.

10. The golf club of claim 1, further comprising:

guide plug means within the tubular stem, to which the upper portion of the spike is secured; and leaf spring means secured to the guide plug and bearing frictionally against the inside of the wall of the tubular stem.

* * * * *